US011465869B2

(12) United States Patent
Hornick et al.

(10) Patent No.: US 11,465,869 B2
(45) Date of Patent: Oct. 11, 2022

(54) GUIDE ROLLER AND TRANSPORT DEVICE COMPRISING SEVERAL ROLLERS

(71) Applicant: BOBST MEX SA, Mex (CH)

(72) Inventors: Paul Hornick, Vufflens-le-Chateau (CH); Gilles Pillonel, Shanghai (CN)

(73) Assignee: BOBST MEX SA, Mex (CH)

( * ) Notice: Subject to any disclaimer, the term of this patent is extended or adjusted under 35 U.S.C. 154(b) by 777 days.

(21) Appl. No.: 16/318,546

(22) PCT Filed: Jul. 12, 2017

(86) PCT No.: PCT/EP2017/025200
§ 371 (c)(1),
(2) Date: Jan. 17, 2019

(87) PCT Pub. No.: WO2018/015025
PCT Pub. Date: Jan. 25, 2018

(65) Prior Publication Data

US 2021/0292123 A1 Sep. 23, 2021

(30) Foreign Application Priority Data

Jul. 19, 2016 (EP) ..... 16020275

(51) Int. Cl.
*B65H 27/00* (2006.01)
*B65H 9/16* (2006.01)

(52) U.S. Cl.
CPC ..... *B65H 27/00* (2013.01); *B65H 9/166* (2013.01); *B65H 2404/117* (2013.01);
(Continued)

(58) Field of Classification Search
CPC ..... B65H 27/00; B65H 2404/1122; B65H 2404/117; B65H 9/166
See application file for complete search history.

(56) References Cited

U.S. PATENT DOCUMENTS 4,425,694 A 1/1984 Somerville
4,823,689 A 4/1989 Kishino et al.
(Continued)

FOREIGN PATENT DOCUMENTS

CN 203345810 U 12/2013
DE 29722737 U1 2/1998
(Continued)

OTHER PUBLICATIONS

International Search Report issued in PCT/EP2017/025200, dated Oct. 4, 2017 (dated Oct. 13, 2017); 4 pages.

*Primary Examiner* — Jeremy R Severson
(74) *Attorney, Agent, or Firm* — Bookoff McAndrews, PLLC

(57) ABSTRACT

A roller for guiding a sheet (101) by friction has a contact surface (2) designed to be in contact with the sheet (101), the contact surface (2) having, overall, a shape of revolution when the roller (1) is at rest, a central portion (6) configured to mechanically connect the roller (1) to a rotating drive element, and a deformation portion (10) located between the contact surface (2) and the central portion (6), the deformation portion (10) being configured to deform elastically when the roller (1) guides the sheet (101) by friction.
The deformation portion (10) comprises at least one cut (12) extending from the contact surface (2) to the central portion (6), the cut (12) being arranged such that the deformation portion (10) comprises at least one elastically deformable segment (16).

14 Claims, 6 Drawing Sheets

(52) U.S. Cl.
CPC ..... *B65H 2404/1122* (2013.01); *B65H 2404/1314* (2013.01); *B65H 2404/1321* (2013.01); *B65H 2701/176* (2013.01)

(56) References Cited

U.S. PATENT DOCUMENTS

| | | | | |
|---|---|---|---|---|
| 5,967,511 | A | 10/1999 | Bell | |
| 6,626,427 | B2 * | 9/2003 | Choi | B65H 3/0638 271/109 |
| 7,445,208 | B2 * | 11/2008 | Onodera | B65H 9/006 271/239 |
| 2003/0193127 | A1 | 10/2003 | Ishibashi | |
| 2004/0255747 | A1 | 12/2004 | Stitz | |
| 2007/0108699 | A1 | 5/2007 | Heemskerk | |
| 2014/0191465 | A1 | 7/2014 | Machamer | |

FOREIGN PATENT DOCUMENTS

| | | | |
|---|---|---|---|
| EP | 1 837 298 | A1 | 9/2007 |
| JP | S5911840 | U | 1/1984 |
| JP | S61 206767 | A | 9/1986 |
| JP | S62215984 | A | 9/1987 |
| JP | H0853251 | A | 2/1996 |
| JP | H1045305 | A | 2/1998 |
| JP | H10258955 | A | 9/1998 |
| JP | H10279114 | A | 10/1998 |
| JP | 2002234638 | A | 8/2002 |
| JP | 2002370851 | A | 12/2002 |
| JP | 2003089447 | A | 3/2003 |
| JP | 2007137677 | A | 6/2007 |
| JP | 2012171337 | A | 9/2012 |
| TW | I325405 | B | 6/2010 |

* cited by examiner

GUIDE ROLLER AND TRANSPORT DEVICE COMPRISING SEVERAL ROLLERS

CROSS-REFERENCE TO RELATED APPLICATION(S)

This application is a National Stage under 35 U.S.C. § 371 of International Application No. PCT/EP2017/025200, filed on Jul. 12, 2017, which claims priority to European Patent Application No. 16020275.0, filed Jul. 19, 2016, the contents of all of which are incorporated by reference in their entirety.

The present invention relates to a roller for guiding a sheet by friction. The present invention further relates to a conveying device comprising such rollers for conveying sheets by friction.

The present invention can for example be applied to the field of making foldable boxes from sheets of cardboard, wherein the roller then serves to guide each sheet of cardboard. A foldable box can for example be a packaging carton. In general, such sheets of cardboard are moved along a production line. In addition, the present invention can find application in other fields requiring the alignment of objects in sheet form such as sheet metal, wooden boards, slabs of plastic material, etc.

PRIOR ART

EP1837298 describes a conveying device comprising multiple rollers for pushing sheets by friction. Each roller has i) an outer surface for contact with the sheet, ii) a central bore for rotation of the roller, and iii) an elastically deformable portion located between the outer contact surface and the central bore.

However, when the conveying device of EP1837298 is used to align a sheet which is slightly offset and/or inclined with respect to a fixed reference end stop (jogging), the alignment of the sheet is dependent on the jogging angle set by the operator. However, when the jogging angle is small, correction of the position of the sheet is very slow. Conversely, when the jogging angle is large, the sheet is aligned more rapidly, but large mechanical stresses are generated when the sheet is pressed against the end stop, which can cause crumpling of the sheet or premature wear of the roller.

SUMMARY OF THE INVENTION

The present invention has, in particular, the object of solving some or all of the above-mentioned problems.

To that end, the present invention relates to a roller for guiding a sheet by friction. The roller has:

- a contact surface designed to be in contact with the sheet, the contact surface having, overall, a shape of revolution when the roller is at rest,
- a central portion configured to mechanically connect the roller to a rotating drive element, and
- a deformation portion located between the contact surface and the central portion, the deformation portion being configured to deform elastically when the roller guides the sheet by friction.

The roller is characterized in that the deformation portion comprises at least one cut extending from the contact surface to the central portion, the cut being arranged such that the deformation portion comprises at least one elastically deformable segment.

Thus, a roller of this type offers greater compliance or lateral flexibility than a roller of the prior art. Indeed, the or each cut defines, on the roller, one or more elastically deformable segments which can flex independently in the axial direction. Thus, this independence in flexing makes it possible to release excessive mechanical stresses once an elastically deformable segment is no longer in contact with the sheet.

For example, when the deformation portion comprises six elastically deformable and independent segments, the roller makes it possible to release the stresses six times per revolution. Such a roller has lateral flexibility which allows the sheet to be aligned against an end stop so as to ensure its orientation prior to processing of the sheet, for example by printing, cutting, laminating or folding and gluing.

In most variants, the contact surface is the radially outermost surface of the roller, that is to say the furthest from the axis of revolution of the contact surface. According to one variant, the axis of the cylinder forming the contact surface coincides with the axis of rotation of the roller when the roller is in the service configuration. According to one variant, the central portion can comprise retention members configured to retain the or each rotating bearing. In particular, the retention members may consist of a cage for rolling-element bearings.

According to one embodiment, the deformation portion of the roller comprises an outer crown and multiple connecting members that mechanically connect the central portion to the outer crown, at least one cut extending through the outer crown so as to interrupt the outer crown at least once.

Each connecting member extends at least in a radial direction. Each connecting member may also extend in another direction, for example in a tangential direction and/or an axial direction.

According to one variant, each connecting member forms in essence a spoke for the roller. According to one variant, the roller has openings located respectively between two consecutive connecting members. Thus, the roller has reduced weight.

As an alternative to this embodiment, the deformation portion is solid. In other words, the deformation portion continuously fills the space between the central portion and the contact surface.

According to one embodiment, multiple connecting members of the roller are formed by pring blades.

According to one embodiment, the roller comprises cutouts located respectively between two consecutive connecting members. According to one variant, multiple cutouts each have a rounded shape. This reduces stresses and increases the lifespan of the rollers. For example, multiple cutouts each have the overall shape of a cylinder extending parallel to an axial direction of the roller.

According to one variant, multiple cutouts each have a triangular shape pointing essentially toward the central portion. According to one variant, the cutouts may be filled with a material that is more elastically deformable than the connecting members.

According to one embodiment, the contact surface of the roller is, overall, in the shape of a cylinder. Thus, such a contact surface can have a large surface area in contact with the sheets. As an alternative to this embodiment, the contact surface is, overall, in the shape of a portion of a torus.

According to one embodiment, the number of cuts of the roller is greater than or equal to two, for example equal to seven. Thus, the roller makes it possible to release the stresses multiple times per rotation, and hence to increase the jogging angle and to more rapidly align the guided sheet.

According to one embodiment, the cuts of the roller are distributed uniformly around the central portion, over the perimeter formed by the contact surface. Thus, such an arrangement of the cuts makes it possible to distribute the mechanical stresses over the roller. In other words, the cuts are distributed uniformly about the axis of rotation of the roller, when the roller is at rest.

According to one embodiment, at least one cut of the roller is configured such that the intersection of the cut with the contact surface forms a segment that is straight and parallel to the axis of revolution of the contact surface. This makes the roller simple to produce. It can for example be extruded or cut by water jet.

According to one embodiment, at least one cut of the roller is configured such that the intersection of the cut with the contact surface forms a segment that is oblique to the axis of revolution of the contact surface. Thus, cuts of this kind allow the sheet to pass progressively from one elastically deformable segment to another, while reducing the amplitude of the vibrations.

According to one embodiment, at least one cut of the roller extends parallel to a plane that includes the oblique segment. In other words, when such a cut is relatively narrow, it has a generally planar shape. As an alternative to this embodiment, at least one cut can have an overall curved shape.

According to another embodiment, the roller with its cuts may comprise least two disks. Thus, a roller divided into multiple disks provides even better lateral flexibility. Indeed, the disks meet at the cuts and define, on the roller, one or more elastically deformable segments which can flex independently in the axial direction.

Such a roller with disks has lateral flexibility, each disk flexing independently of one another. Thus, this independence in the flexing of the disks with respect to one another makes it possible to release excessive mechanical stresses once an elastically deformable disk segment located between two cuts is no longer in contact with the sheet. A roller with disks makes it possible to convey and align the sheet independently of the starting position of the sheet.

According to yet another embodiment, the disks are coaxial, the disks are mutually parallel, the disks are of the same thickness, the disks are spaced apart from one another and the disks are equidistant from one another.

Furthermore, the present invention relates to a conveying device, for conveying, by friction, sheets, for example sheets of cardboard intended for making foldable boxes, the conveying device comprising an end stop and multiple rollers as described and claimed, the rollers being inclined so as to guide and align each sheet against the end stop.

In one variant, the conveying device comprises at least two pairs of rollers as described and claimed, each pair of rollers including an upper roller and a lower roller that are arranged face-to-face so as to grip a sheet between them, the conveying device further comprising a rotating drive element, which is secured to the central portion of at least one of the rollers of each pair of rollers such that the rotating drive element can transmit a torque to at least one of the rollers of each pair of rollers.

According to one variant, the conveying device further comprises a rotating drive element that is secured to the central portion such that the rotating drive element can transmit a torque to the roller.

The above-mentioned embodiments and variants can be considered in isolation or in any technically possible combination.

BRIEF DESCRIPTION OF THE DRAWINGS

The present invention will be easily understood and its advantages will also become apparent from the description which will follow, which is given solely by way of nonlimiting example and makes reference to the attached figures in which identical reference signs correspond to elements that are structurally and/or functionally identical or similar. In the attached figures.

DETAILED DESCRIPTION OF PREFERRED EMBODIMENTS

Figure 1:
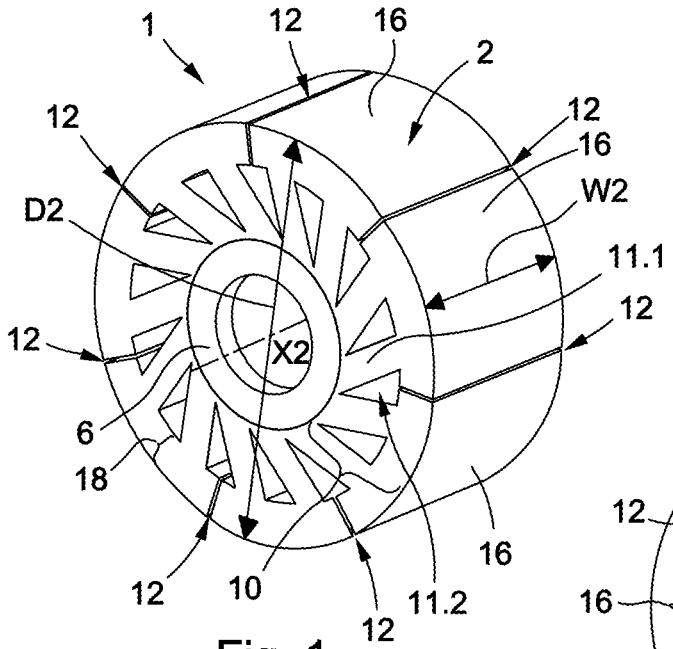
FIGS. 1 and 2 show, respectively, a perspective view, from two different viewpoints, of a roller according to a first embodiment of the invention.
Figure 2:
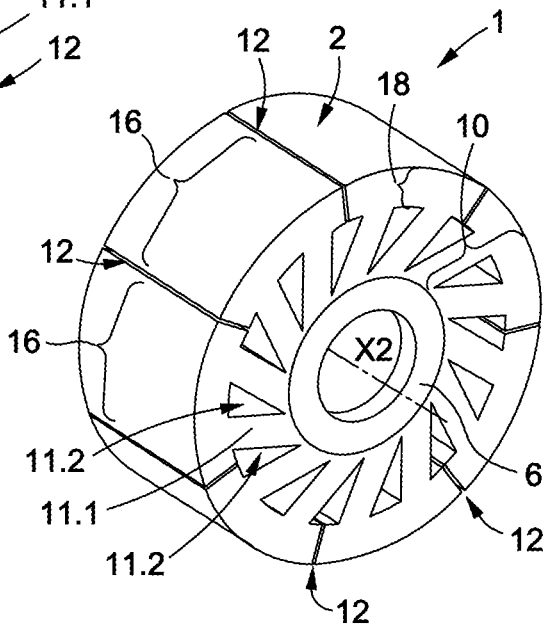
Figure 3:
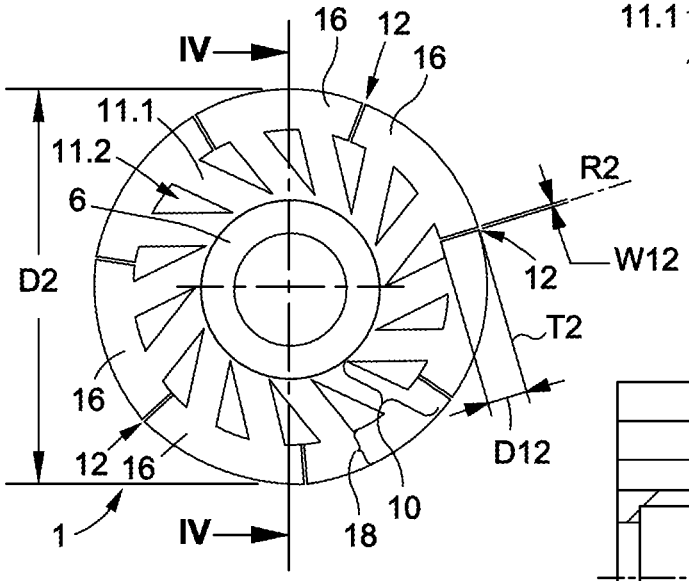
FIG. 3 shows a lateral view of the roller of FIGS. 1 and 2.
Figure 4:
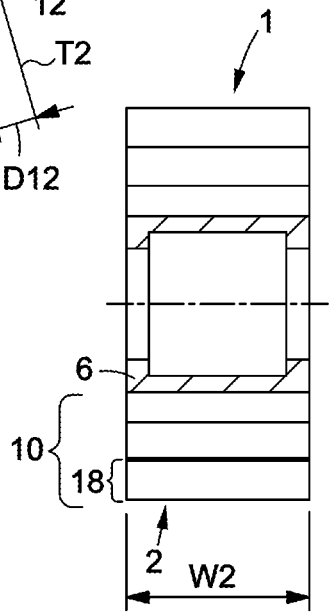
FIG. 4 shows a view in section, on the plane IV-IV, of the roller in FIG. 3.
Figure 5:
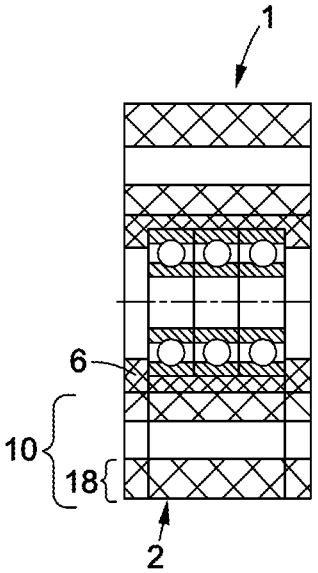
FIG. 5 shows a view, similar to FIG. 4, of the roller of FIG. 4, equipped with ball bearings.

FIGS. 1 to 5 illustrate a roller 1 for guiding a sheet 101 by friction. The roller 1 has a contact surface 2 designed to be in contact with a sheet 101. The contact surface 2 has, overall, a shape of revolution when the roller 1 is at rest. In this case, the contact surface 2 is, overall, in the shape of a cylinder.

Here, the contact surface 2 is the radially outermost surface of the roller 1, that is to say the furthest from the axis of revolution X2 of the contact surface 2. The axis of the cylinder forming the contact surface 2 coincides with the axis of rotation of the roller 1 when the roller 1 is at rest.

According to one variant, the roller is made at least in part of a flexible material, for example a polyurethane. By way of exemplary embodiment, a roller according to the invention can have:

- a diameter D2 approximately equal to 60 mm,
- a width W2 approximately equal to 30 mm,
- at least one slot having a width W12 approximately equal to 1 mm,
- a hardness approximately equal to 60 ShoreA, the hardness being measured at the contact surface.

The roller 1 has a central portion 6 that is configured to mechanically connect the roller 1 to a rotating drive element, as shown in FIGS. 13 to 16.

The roller 1 has a deformation portion 10 that is located between the contact surface 2 and the central portion 6. The deformation portion 10 is configured to deform elastically when the roller 1 guides the sheet 101 by friction.

In this case, the deformation portion 10 has six cuts 12. Each one of the cuts 12 extends from the contact surface 2 to the central portion 6. Each cut 12 is arranged such that the deformation portion 10 comprises, in this case, six elastically deformable segments 16. Here, the cuts 12 are distributed uniformly about the central portion 6.

The deformation portion 10 comprises an outer crown and multiple connecting members 11.1. The connecting members 11.1 mechanically connect the central portion 6 to the outer crown 18. In the example of FIGS. 1 to 5, cuts 12 extend through the outer crown 18 so as to interrupt the outer crown 18 six times.

Each connecting member 11.1 forms in essence a spoke for the roller 1. The roller 1 has cutouts 11.2 located respectively between two consecutive connecting members 11.1. Each cutout 11.2 has a triangular shape pointing essentially toward the central portion 6.

In the example of FIGS. 1 to 5, each cut 12 is configured such that the intersection of this cut 12 with the contact surface 2 forms a segment that is straight and parallel to the axis of revolution X2 of the contact surface 2.

Figure 6:
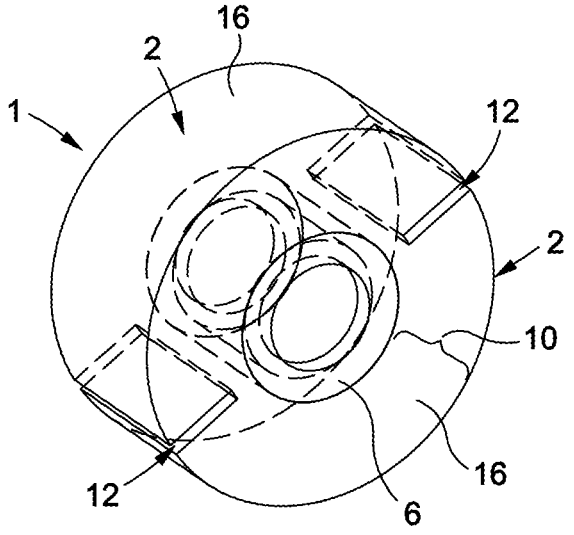
FIGS. 6 and 7 show, respectively, a see-through perspective view, and a lateral view, of a roller according to a second embodiment of the invention.
Figure 7:
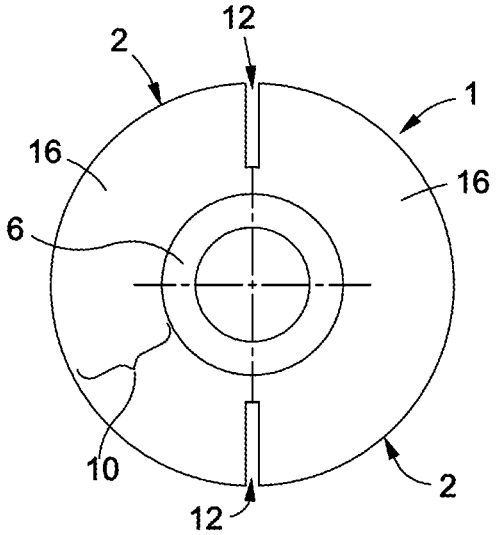

FIGS. 6 and 7 illustrate a roller 1 according to a second embodiment. Insofar as the roller 1 of FIGS. 6 and 7 is similar to the roller 1 of FIG. 1, the description of the roller 1 provided hereinabove in relation to FIG. 1 can be transposed to the roller 1 of FIGS. 6 and 7, with the exception of the notable differences mentioned hereinbelow. The roller 1 of FIGS. 6 and 7 differs from the roller 1 of FIG. 1 in that the deformation portion 10 has two cuts 12, instead of six, which extend from the contact surface 2 to the central portion 6. Furthermore, the roller 1 of FIGS. 6 and 7 differs from the roller 1 of FIG. 1 in that the deformation portion 10 has no cutouts. Quite the opposite: the deformation portion 10 is solid. However, as in the example of FIG. 1, the deformation portion 10 is configured to deform elastically when the roller 1 guides the sheet 101 by friction.

Figure 8:
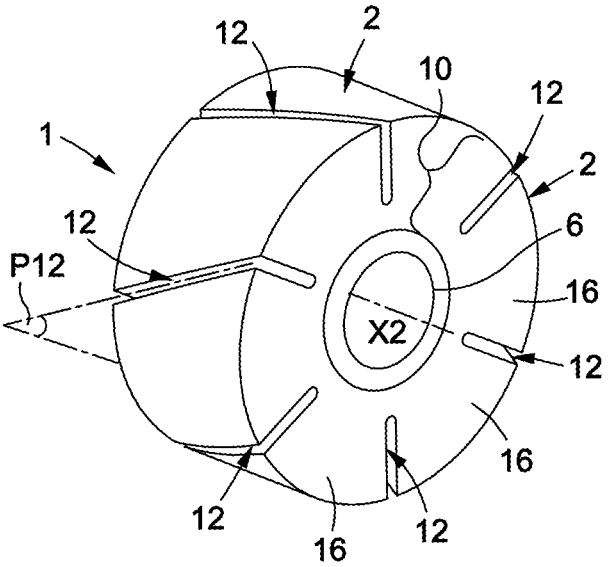
FIGS. 8 and 9 show, respectively, a perspective view, and a see-through lateral view, of a roller according to a third embodiment of the invention.
Figure 9:
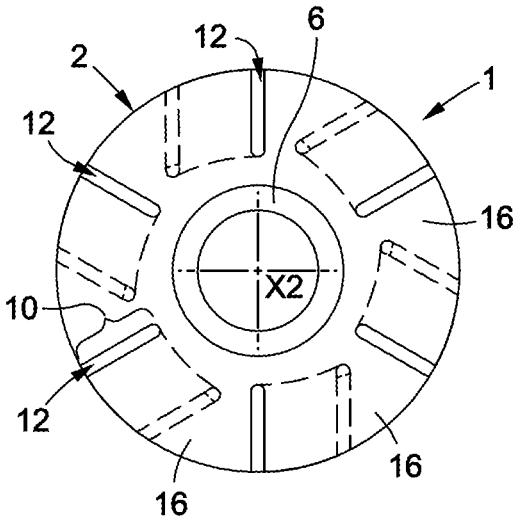

FIGS. 8 and 9 illustrate a roller 1 according to a third embodiment. Insofar as the roller 1 of FIGS. 8 and 9 is similar to the roller 1 of FIG. 1, the description of the roller 1 provided hereinabove in relation to FIG. 1 can be transposed to the roller 1 of FIGS. 8 and 9, with the exception of the notable differences mentioned hereinbelow. The roller 1 of FIGS. 8 and 9 differs from the roller 1 of FIG. 1 in that each cut 12 is configured such that the intersection of this cut 12 with the contact surface 2 forms a segment that is oblique to the axis of revolution X2 of the contact surface 2. As shown in FIG. 8, each cut 12 extends parallel to a plane P12 which includes the oblique segment.

Figure 10:
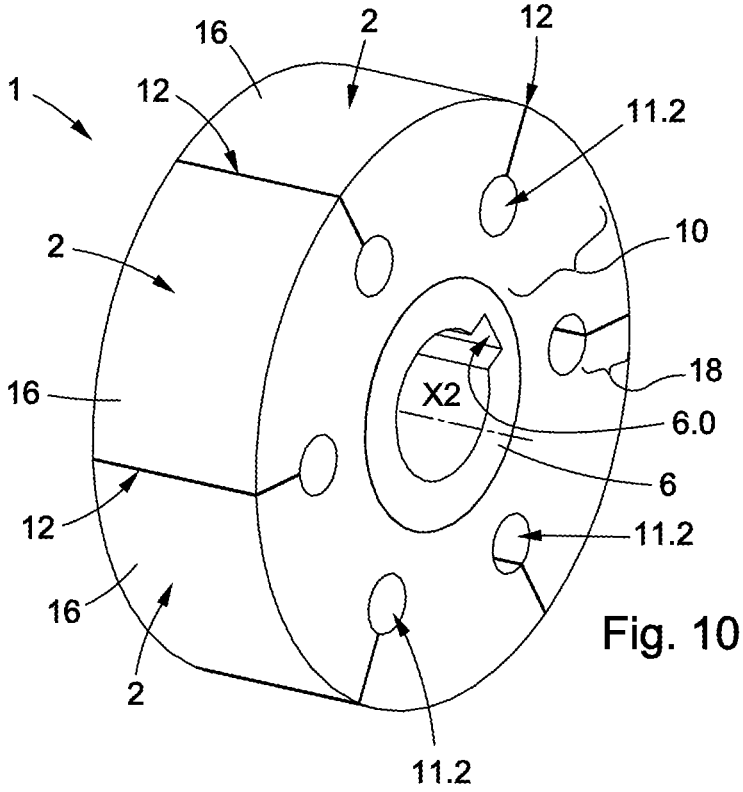
FIGS. 10 and 11 show, respectively, a perspective view, and a lateral view, of a roller according to a fourth embodiment of the invention.
Figure 11:
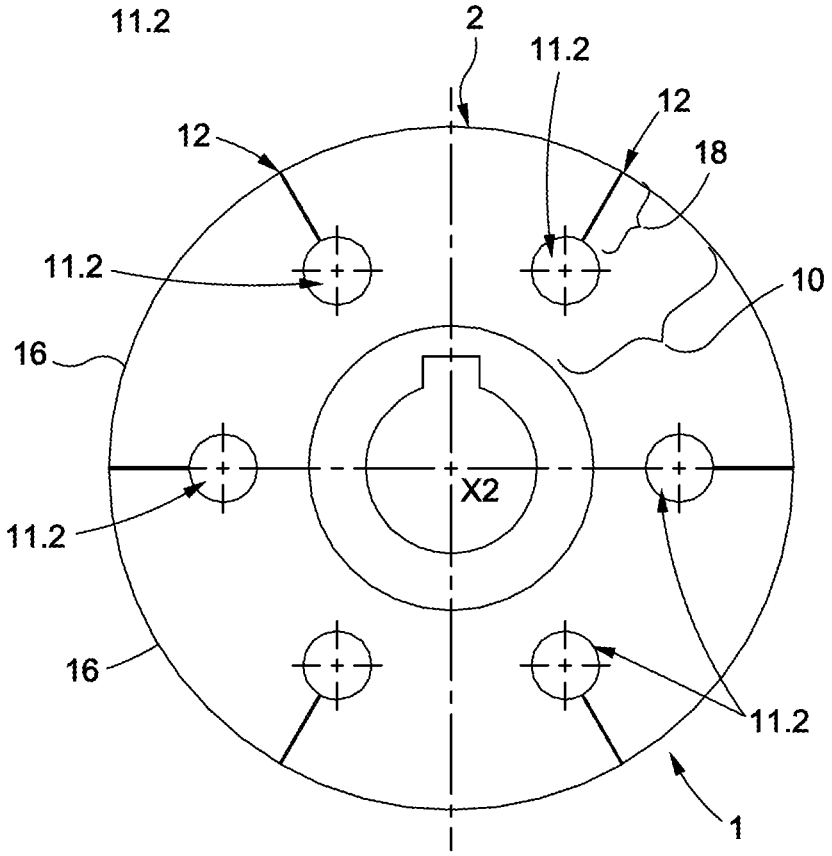

FIGS. 10 and 11 illustrate a roller 1 according to a fourth embodiment. Insofar as the roller 1 of FIGS. 10 and 11 is similar to the roller 1 of FIG. 1, the description of the roller 1 provided hereinabove in relation to FIG. 1 can be transposed to the roller 1 of FIGS. 10 and 11, with the exception of the notable differences mentioned hereinbelow. The roller 1 of FIGS. 10 and 11 differs from the roller 1 of FIG. 1 in that each cutout 11.2 has a rounded shape, in order to reduce mechanical stresses. Each cutout 11.2 has the overall shape of a cylinder extending parallel to an axial direction X2 of the roller 1. Furthermore, the central portion 6 has a slot 6.0 that is configured to receive a key (not shown). The slot 6.0 extends parallel to the axial direction X2.

Figure 12:
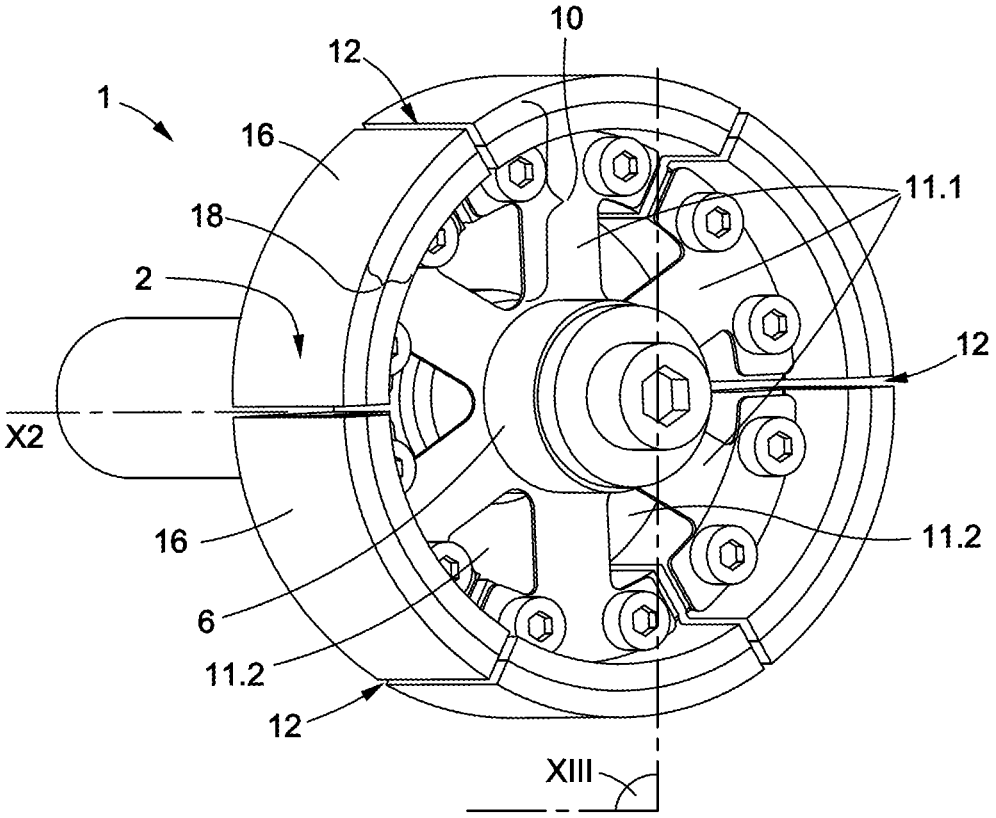
FIG. 12 shows a perspective view of a roller according to a fifth embodiment of the invention.
Figure 13:
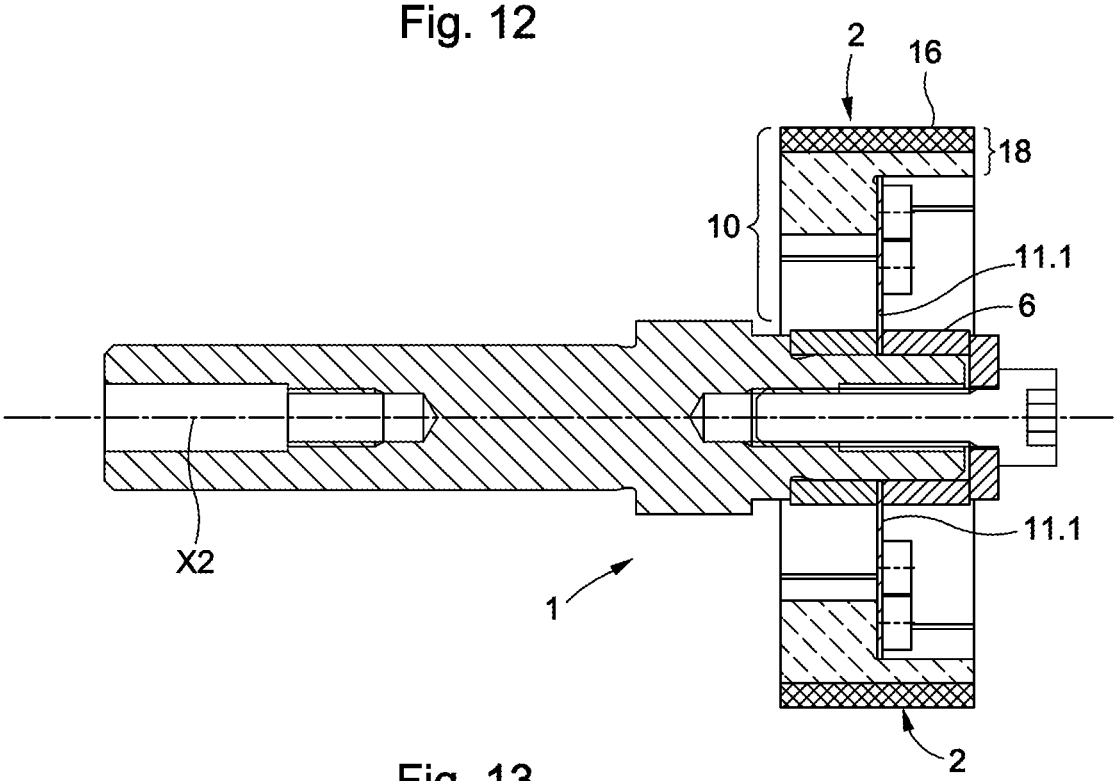
FIG. 13 shows a view in section, on the plane XIII, of the roller in FIG. 12.

FIGS. 12 and 13 illustrate a roller 1 according to a fifth embodiment. Insofar as the roller 1 of FIGS. 12 and 13 is similar to the roller 1 of FIG. 1, the description of the roller 1 provided hereinabove in relation to FIG. 1 can be transposed to the roller 1 of FIGS. 12 and 13, with the exception of the notable differences mentioned hereinbelow. The roller 1 of FIGS. 12 and 13 differs from the roller 1 of FIG. 1 in that each connecting member 11.1 is formed by a respective spring blade. Furthermore, as for the roller 1 of FIG. 1, each cutout 11.2 has a triangular shape pointing essentially toward the central portion 6.

Figure 14:
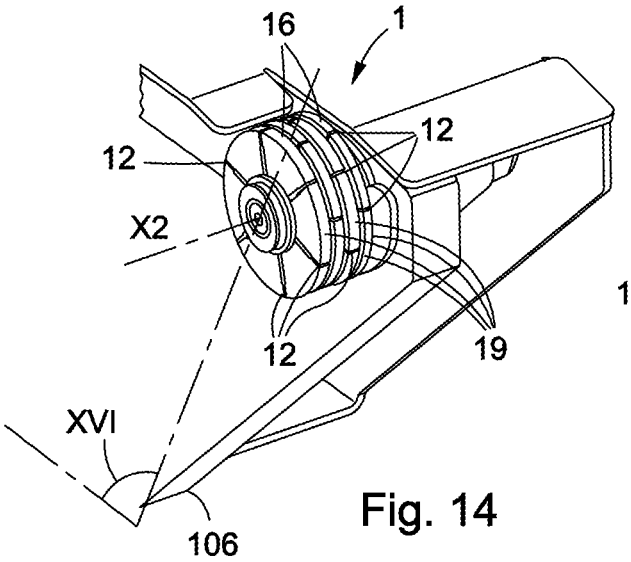
FIG. 14 shows a partial perspective view of a roller according to a sixth embodiment of the invention, mounted in a conveying device.
Figure 15:
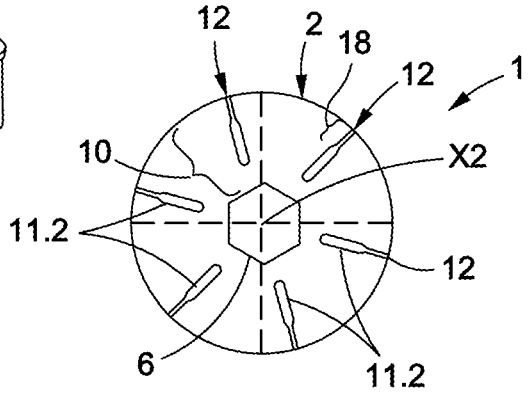
FIG. 15 shows a lateral view of the roller of FIG. 14.
Figure 16:
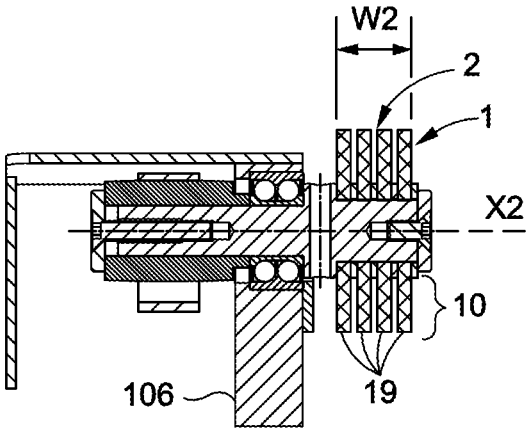
FIG. 16 shows a view in section, on the plane XVI, of the roller in FIG. 14.

FIGS. 14 and 16 illustrate a roller 1 according to a sixth embodiment. Six cuts 12 extend from the contact surface 2 to the central portion 6. Each cut 12 is configured such that the intersection of this cut 12 with the contact surface 2 forms a segment that is straight and parallel to the axis of revolution X2 of the contact surface 2. Insofar as the roller 1 of FIGS. 14 to 16 is similar to the roller 1 of FIG. 1, the description of the roller 1 provided hereinabove in relation to FIG. 1 can be transposed to the roller 1 of FIGS. 14 to 16, with the exception of the notable differences mentioned hereinbelow.

The roller 1 of FIGS. 14 to 16 differs from the roller 1 of FIG. 1 first of all in that each cutout 11.2 is in line with each one of the cuts 12. Furthermore, each cutout 11.2 has an elongate shape pointing essentially toward the central portion 6 and having a width greater than the width W12 of the corresponding cut 12.

Furthermore, the roller 1 is formed with at least two disks 19 that are mutually parallel, coaxial and spaced apart from one another. The disks 19 are of the same thickness, are equidistant from one another, and are held on the central hub 20. The space between two disks 19 extends from the contact surface 2 to the central portion 6. The cuts 12 of the roller 1 are created at the surface of one or more disks 19, uniformly around the central portion 6, on the perimeter formed by the contact surface 2.

The roller 1 of the sixth embodiment comprises four disks 19. The deformation portion 10, and thus the contact surface 2, of the roller 1 are thus divided into four, across the width W2. With four disks 19 and six cuts 12 on each of the four disks 19, the contact surface 2 comprises twenty-four elastically deformable segments 16. In this embodiment, the cuts 12 of a disk 19 are offset with respect to the cuts of the immediately adjacent disk.

Figure 17:
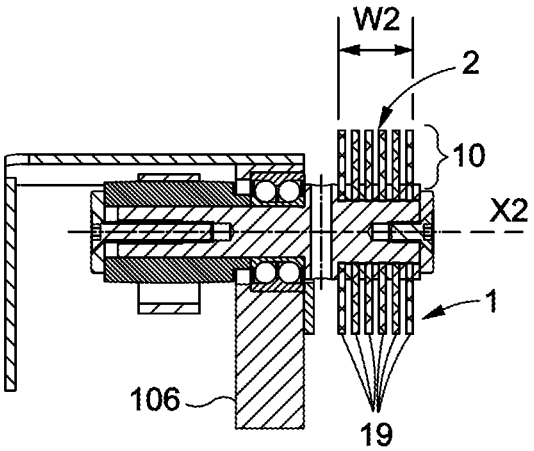
FIG. 17 shows a view in section of a roller according to a seventh embodiment of the invention.

The roller 1 of the seventh embodiment, in FIG. 17, differs from the roller 1 of FIG. 1 in that it consists of six disks 19 that are mutually parallel, coaxial and spaced apart from one another. The six disks 19 are of the same thickness, are equidistant from one another, and are held on the central hub 20. The deformation portion 10, and thus the contact surface 2, of the roller 1 are thus divided into six, across the width W2. With six disks 19 and six cuts 12 on each of the six disks 19, the contact surface 2 comprises thirty-six elastically deformable segments 16.

Figure 18:
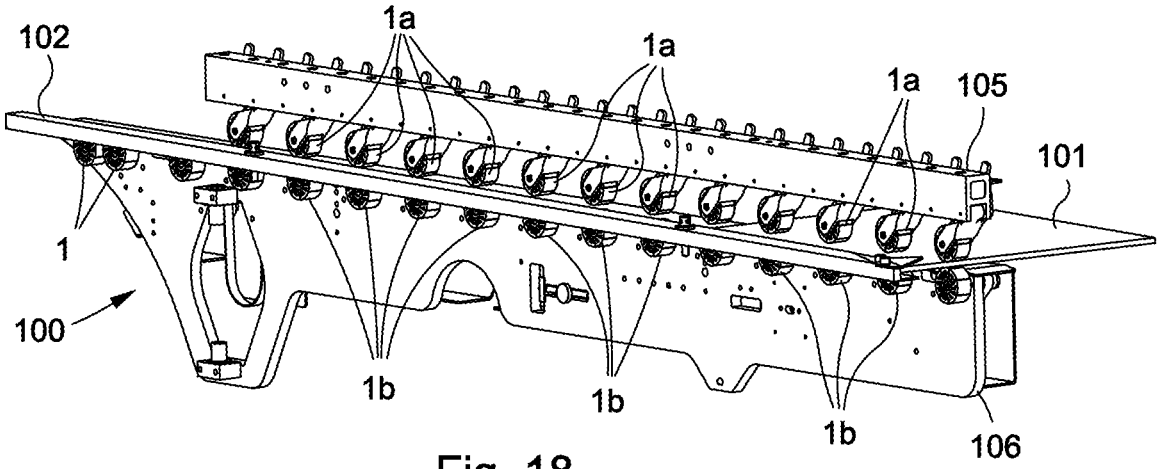
FIG. 18 shows a perspective view of a conveying device according to the invention, comprising multiple idling rollers and multiple driving rollers according to the invention.
Figure 19:
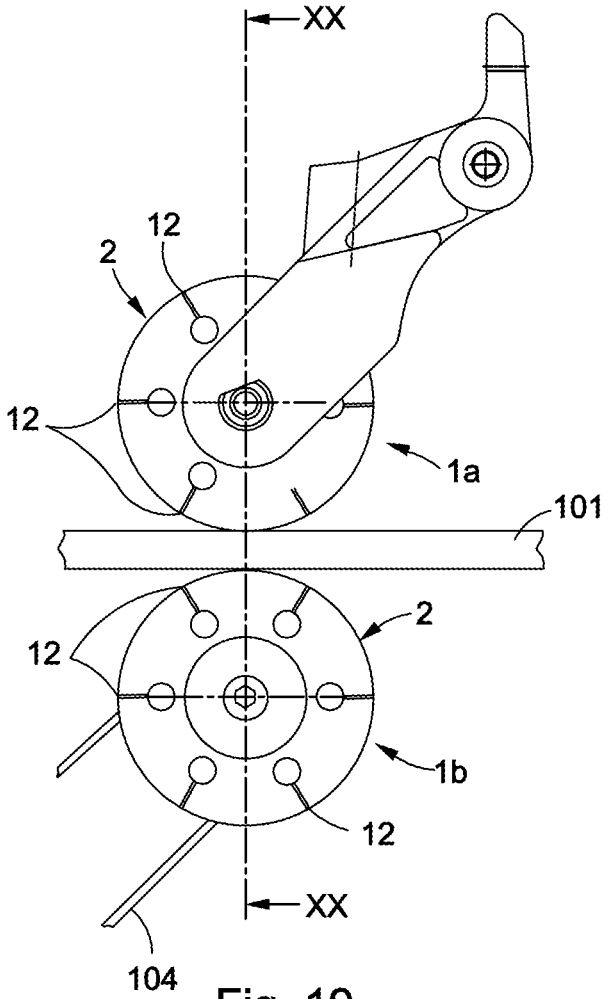
FIG. 19 shows a lateral view of a pair of rollers of the conveying device in FIG. 18.
Figure 20:
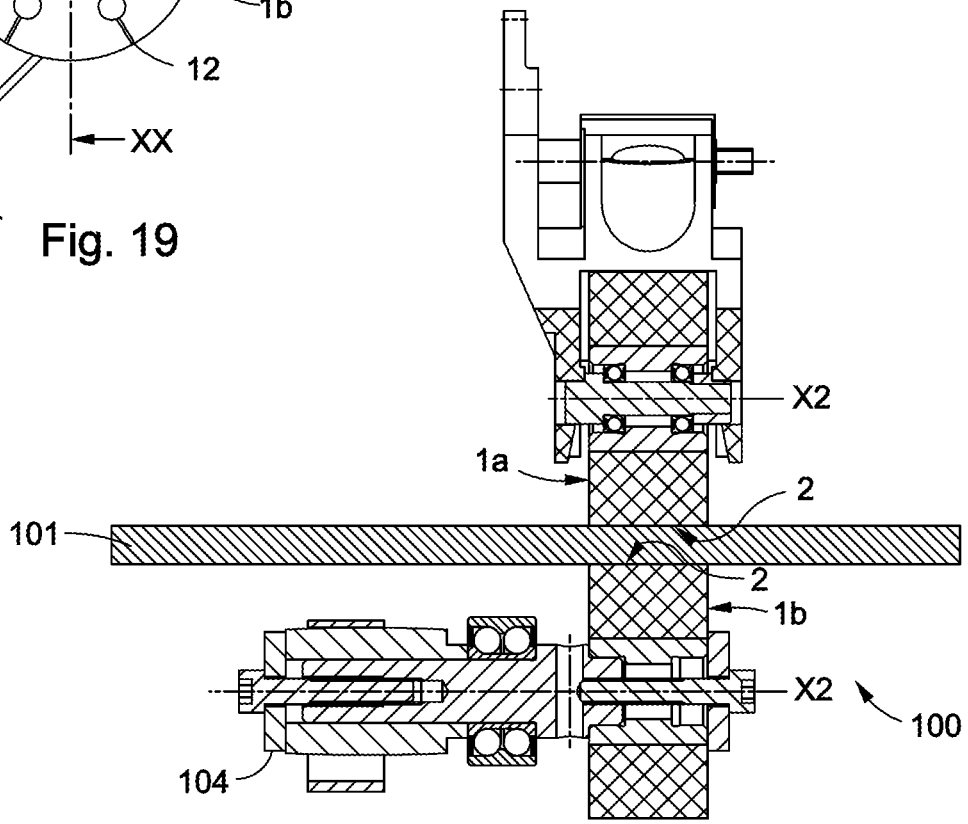
FIG. 20 shows a view in section, on the plane XX, of the pair of rollers in FIG. 19.

FIGS. 18, 19 and 20 illustrate a conveying device 100 according to the invention. The conveying device 100 serves to convey, by friction, sheets 101, in this case sheets of cardboard intended for making foldable boxes.

The conveying device 100 comprises an end stop 102 and multiple pairs of rollers 1*a* and 1*b*, comprising idling rollers 1*a* and driving rollers 1*b*. The rollers 1*a* and 1*b* are inclined in the direction of the end stop 102 so as to guide, bring and align each sheet 101 against this end stop 102. Thus, a tangent to the contact surface 2 of the rollers 1*a* and 1*b* is different to the main longitudinal axis of conveyance of the sheets. The tangent to the contact surface 2 is oriented in the direction of the end stop 102.

Each pair of rollers 1 comprises an upper roller 1*a* and a lower roller 1*b* that are arranged face-to-face so as to grip a sheet 101 between them. The rollers 1*a* and 1*b* are made in a similar manner to the above-described rollers 1. The conveying device 100 further comprises, for the lower rollers 1*b*, a rotating drive element 104 which is secured to the central portion 6 such that the rotating drive element 104 can transmit a torque to the roller 1*b* when the rotating drive element 104 is connected to an actuator.

The conveying device 100 further comprises rotating drive elements that are respectively secured to the central portions of the rollers of each pair of rollers 1*a* and 1*b*, such that the rotating drive element can transmit a torque to at least one of the rollers 1 of each pair of rollers 1*a* and 1*b*. In this exemplary embodiment, the drive element can comprise a belt 104. The upper rollers 1*a* are held by an upper beam 105. The lower rollers 1*b* are held by a lower beam 106.

The invention is not limited to the particular embodiments described, nor to embodiments within the scope of the person skilled in the art. Other embodiments may be envisioned without departing from the scope of the invention, on the basis of any element equivalent to an element indicated in the present patent application.

The invention claimed is:

1. A roller for guiding a sheet by friction, the roller having:

a contact surface designed to be in contact with the sheet, the contact surface having a shape of revolution when the roller is at rest, a central portion configured to mechanically connect the roller to a rotating drive element, and a deformation portion located between the contact surface and the central portion, the deformation portion being configured to deform elastically when the roller guides the sheet by friction, wherein the deformation portion comprises:

at least one cut extending from the contact surface towards the central portion, the at least one cut being arranged such that the deformation portion comprises at least one elastically deformable segment, and an outer ring and a plurality of connection members mechanically connecting the central portion and the outer ring, wherein the at least one cut extends through the outer ring, and the outer ring mechanically connects at least two connection members of the plurality of connection members.

2. The roller of claim 1, wherein each connection member of the plurality of connection members forms a spoke for the roller.

3. The roller of claim 1, in which the plurality of connecting members are formed by spring blades.

4. The roller of claim 1, comprising cutouts located respectively between two consecutive connecting members.

5. The roller of claim 1, in which the contact surface is, overall, in the shape of a cylinder.

6. The roller of claim 1, in which the at least one cut includes a number of cuts greater than or equal to two.

7. The roller of claim 6, in which the cuts are distributed uniformly around the central portion.

8. The roller of claim 1, in which the at least one cut is configured such that the intersection of the at least one cut with the contact surface forms a segment that is straight and parallel to the axis of revolution of the contact surface.

9. A conveying device, for conveying, by friction, a sheet, the conveying device comprising an end stop and multiple rollers as claimed in claim 1, the rollers being inclined so as to guide and align the sheet against the end stop.

10. The conveying device of claim 9, comprising at least two pairs of rollers, each pair of rollers including an upper roller and a lower roller that are arranged face-to-face so as to grip the sheet between them, the conveying device further comprising a rotating drive element, which is secured to the central portion of at least one of the upper roller or the lower roller of each pair of rollers such that the rotating drive element can transmit a torque to the at least one of the upper roller or the lower roller of each pair of rollers.

11. A roller comprising:

a central portion connected to a rotating drive element;

a deformation portion around an outer circumference of the central portion; and a contact surface around an outer circumference of the deformation portion, wherein a notch extends through the contact surface and the deformation portion and has a radial depth less than a radial thickness of the deformation portion, wherein an axial extension of the notch is oblique to an axial extension of the central portion.

12. The roller of claim 11, wherein a circumferential width of the notch is uniform along the radial depth of the notch.

13. The roller of claim 11, wherein a circumferential width of the notch varies along the radial depth of the notch.

14. The roller of claim 11, wherein the deformation portion further includes a cutout enclosed in the deformation portion.

* * * * *